US005108860A

United States Patent [19]

Birkle et al.

[11] Patent Number: 5,108,860

[45] Date of Patent: Apr. 28, 1992

[54] ELECTROPHOTOGRAPHIC RECORDING MATERIAL AND METHOD FOR THE MANUFACTURE THEREOF

[75] Inventors: Siegfried Birkle, Hoechstadt A/Aisch; Johann Kammermaier, Unterhaching; Roland Rubner, Lauf, all of Fed. Rep. of Germany

[73] Assignee: Siemens Aktiengesellschaft, Munich, Fed. Rep. of Germany

[21] Appl. No.: 552,524

[22] Filed: Jul. 16, 1990

[30] Foreign Application Priority Data

Jul. 19, 1989 [DE] Fed. Rep. of Germany ..... 3923930
Jul. 19, 1989 [DE] Fed. Rep. of Germany ..... 3923931

[51] Int. Cl.[5] ..... G03G 5/085

[52] U.S. Cl. ..... 430/57; 430/66; 430/128; 430/132

[58] Field of Search ..... 430/57, 58, 66, 67, 430/128, 132

[56] References Cited

U.S. PATENT DOCUMENTS 4,868,076 9/1989 Iino et al. ..... 430/66
4,886,724 12/1989 Masaki et al. ..... 430/66
4,898,798 2/1990 Sugata et al. ..... 430/66
4,950,571 8/1990 Hotomi et al. ..... 430/66

FOREIGN PATENT DOCUMENTS 0250916 1/1988 European Pat. Off. .
3201146 9/1982 Fed. Rep. of Germany .
3631350 3/1987 Fed. Rep. of Germany .

OTHER PUBLICATIONS

Heywang, W., "Amorphe und polykvistalline Halbleiter", 1984, Springer-Verlag, Berlin, Heidelberg, New York, Tokyo, pp. 40–48.

*Primary Examiner*—John Goodrow
*Attorney, Agent, or Firm*—Hill, Van Santen, Steadman & Simpson

[57] ABSTRACT

An electrophotographic recording material is applied on a plate-shaped or drum-shaped substrate in a layer structure of superposed layers which comprises a photoconductive layer and at least the uppermost layer is fashioned of amorphous, hydrogen-containing carbon. The amorphous, hydrogen-containing carbon layer is deposited from a radio frequency excited low-pressure plasma with gaseous hydrocarbon as a reaction gas and in which a self-bias DC voltage is superimposed on the radio frequency field. The a-C:H material obtained in this manner is semiconducting and has photoconductive properties so that it can be employed for the photoconductive layer of the electrophotographic recording material.

16 Claims, 1 Drawing Sheet

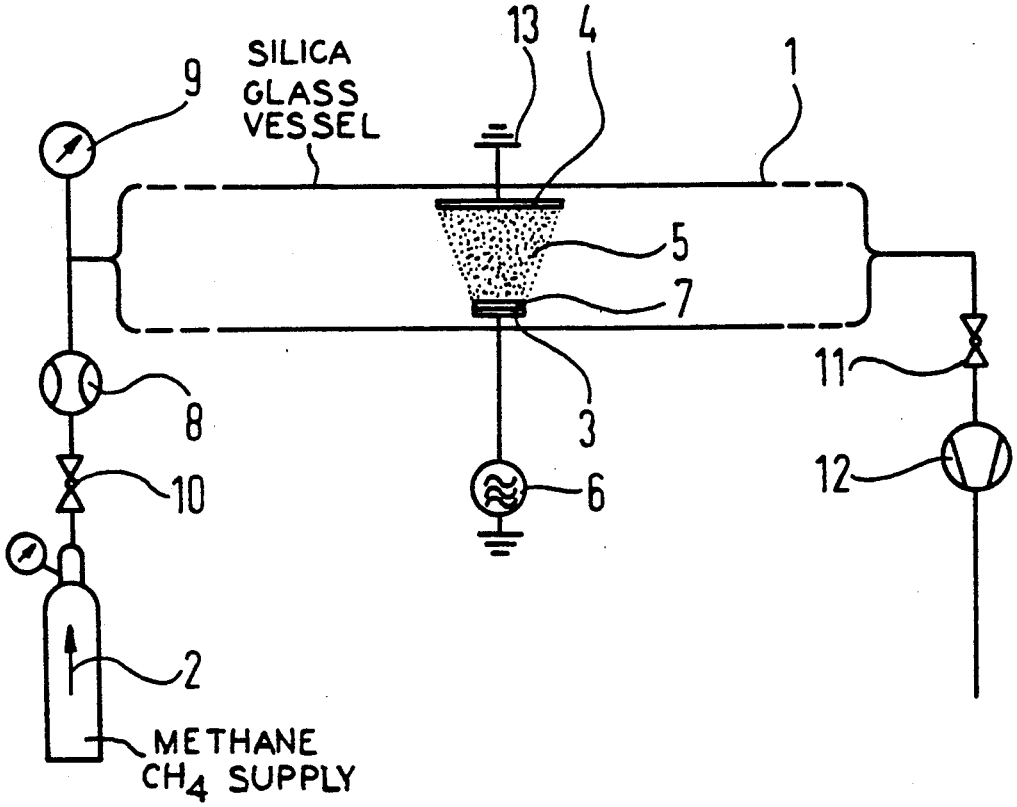
SILICA
GLASS
VESSEL
13
4
1
9
5
7
11
8
3
12
10
6
2
METHANE
$CH_4$ SUPPLY

ELECTROPHOTOGRAPHIC RECORDING MATERIAL AND METHOD FOR THE MANUFACTURE THEREOF

BACKGROUND OF THE INVENTION

1. Field of the Invention

The present invention relates to photocopying and is particularly concerned with improvements in photocopying material and the method of its manufacture.

2. Description of the Prior Art

The basic principle of the current, widespread xerographic copying method (electrophotography) lies in initially generating a latent, electrical charge image of the characters to be transferred on and intermediate carrier, in electrostatically agglomerating colorant particles to the latent image and, finally, in transferring the colorant onto the ultimate carrier (paper) and, for example, fixing it thereon by heat.

The intermediate carrier then is applied on a planar electrode (plate or drum) can be constructed of one or more layers. Given the single-layer structure, the following requirements are made of this layer;

1. An adequate photoconductivity must be present in order to be able to convert light signals into electrically-acquirable pulses. Values above $10^{-5}$ $cm^2/Vs$ are adequate for the mobility of the charge carriers and values greater than $10^{-2}$ electrons/photons are adequate for the intrinsic quantum yield;
2. The dark conductivity must be below $10^{-10}$ (ohm meter)$^{-1}$ and the dielectric strength must be greater than 100 V/μm so that the unexposed layer can be electrostatically charged (corona discharge) and the charges are prevented from undesirably flowing off;
3. No cross diffusion or only slight cross diffusion of the surface charges should be present during the copying process in order to avoid unsharpness of image or errors. This requires an adequate number of localized conditions (adhesion locations) in the surface;
4. The material must have a high thermal conductivity in order to oppose excessive heating due to light absorption and also in order to suppress potential thermoelectric effects;
5. A high resistance to wear vis-a-vis the paper bands running during copying should be present, at least in the surface region;
6. The material should be uniform, i.e. should have amorphous structure;
7. The material should be moisture-insensitive in order to avoid effects of tracking currents through the layer;
8. The material should have no toxic effects;
9. The manufacture should be possible in a large-area process and should be simple to execute; and
10. The material should have an optical band spacing Eg below 3 eV in order to absorb the visible range.

As may be derived from the book by W. Heywang, "Amorphe und polykristalline Halbleiter", Springer Verlag, Berlin, 1984, pp. 40–46, thin, polycrystalline or, respectively, amorphous, toxic selenium layers are still currently used in 90% of cases as electrically chargeable, photoconductive intermediate image carriers for electrophotographic processes, these selenium layers being distinguished by favorable transport properties for optoelectrically generated charge carriers and by low cross diffusion of the charges. What is thereby advantageous is that photoconduction can only be achieved with shortwave physiologically harmful light below 400 nm and that the layers are mechanically sensitive and can usually be photoelectrically employed only in combination with thin cadmium electrodes.

The utilization of amorphous, hydrogen-containing silicon layers (a—Si: H layers) as latent intermediate image carriers in the electrophotographic copying process is also known (Heywang suora, p. 47). The material a—Si:H has a high photoconductivity but it is usually only utilized as a charge-generating layer in combination with another layer that guarantees a better charge transport, for example, a—C:H material, as disclosed, for example, in the European application 0 250 910. Since it is moisture sensitive as a result of thin oxide layers and is also mechanically stable only to a limited degree, A—Si:H layer must usually already be covered by a thin protective layer.

The method of layer combination as disclosed, for example, in the European Patent Application 0 250 916 or in the German patent 3,201,146 C2 is very involved in technological terms.

An extensive listing of possible layer combinations and their conceivable embodiments may be derived from the German published application 36 31 350. An electrophotographic recording material disclosed therein can comprise up to five different layers lying on top of one another, these being applied over an electrically-conductive substrate. In this arrangement, a separate function is assigned to each layer, so that the requirements set forth above no longer need be met by a single layer. Therefore, for example, a barrier or adhesion layer can be initially provided directly over the substrate. A charge transporting layer is provided between the charge generating layer and the adhesion layer in order to enable the charge carriers generated in the exposure to flow off to the substrate. A further charge transport layer above the mentioned charge generating layer enables the transport of charge carriers of the other type to the uppermost layer in order to neutralize the electrostatic charging seated there at the unexposed locations.

This uppermost layer serves as a barrier and a protective layer and is the carrier of the electrostatic charge. At the same time, it must also withstand the mechanical demands in the printing process over a long term.

As likewise known from the book of W. Heywang, Suora, p. 47, organic polymers are utilized as photoconductors in electrophotography in addition to the mentioned amorphous semiconductor materials, most often charge carrier complexes of trinitrofluorene (TNF acceptor) and polyvinyl polyvinylcarbazole (PVC donor). These systems can be cost-effectively manufactured in a large-area manner; however, their charge carrier mobility is extremely low and their mechanical stability and the thermoconduction are only slight.

SUMMARY OF THE INVENTION

It is therefore an object of the present invention to provide a new electrophotographic recording material that has a simplified structure and thereby meets the requirements initially set forth.

This object is achieved, according to the present invention, by an electrophotographic recording material that is applied in a layer format on a plate-shaped or drum-shaped substrate;

comprises a photoconductive layer; and wherein at least the uppermost layer is composed of amorphous, hydrogen-containing carbon (a—C:H).

It is thereby provided in accordance with a feature of the invention that the amorphous, hydrogen-containing carbon layer is the photoconductive layer.

According to a particular feature of the invention, the recording material is particularly characterized in that the photoconductive a—C:H layer is applied over a layer composed of a carbide-forming semiconductor material.

According to another feature of the invention, the recording material is particularly characterized in that the carbide-forming material is amorphous silicon (a—Si:H).

According to another feature of the invention, the recording material is particularly characterized in that a photoconductive a—C:H layer comprises an optical band spacing of 0.8–2.8 eV, an H/C ratio of 0.15–0.6, preferably 0.3, and a $sp^3$ hybridization degree of the C atoms of at least 68%.

According to another feature of the invention, the recording material is particularly characterized in that the uppermost layer is constructed of a—C:H as a protective layer over a photoconductive layer composed of some other material.

Another object of the invention is to provide a method of manufacturing the recording material.

To this end, the method of manufacture is particularly characterized in that, for producing an amorphous, hydrogen-containing layer for an electrophotographic recording material, a radio frequency excited plasma is generated between two electrodes in a hydrocarbon-containing low-pressure atmosphere, and a DC bias voltage is superimposed on the radio frequency field, and the material to be coated is arranged on the cathode, with respect to the DC field.

According to a feature of the invention, the method is further particularly characterized in that the DC voltage is a superimposed, self biased DC voltage that is generated by radio frequency electrodes of different sizes.

According to another feature of the invention, the method is particularly characterized in that the area ratio of cathode to anode is set less than or equal to 1:5.

According to another feature of the invention, the method is particularly characterized by providing a radio frequency power density of 0.5–2 W $cm^2$, an electrode spacing of −5 cm, and a pressure of 100–500 Pa, whereby the pressure and area ratio are matched to one another such that a self bias DC voltage of a maximum of 1000 V arises.

According to another feature of the invention, the method is particularly characterized in that methane, ethane or a mixture of these gases with $H_2$ is employed as the hydrocarbon-containing reaction gas.

According to another feature of &:he invention, the method is particularly characterized in that the substrate or the electrode that carries the substrate is cooled.

The following considerations led to the present invention: amorphous, hydrogen-containing carbon a—C:H is a carbon modification in which an amorphous carbon network is present. As a result of its extremely high mechanical hardness which makes it extraordinarily wear-resistant, this material is also referred to as diamond-like carbon. The C atoms are predominantly bonded by $sp^3$ orbitals and, to a lesser degree, by $sp^2$ orbitals, whereby the bonded hydrogen (H/C ratio of 0.15–0.6) has a structure-stabilizing effect.

On the basis of a suitable deposition process and the selection of specific deposition conditions, the amorphous carbon layer can be generated with such properties that it is most excellently suited as a surface layer for an electrophotographic recording material. The electrical resistance can be set to more than $10^{12}$ Ωm. The thermoconductivity of a—C:H layers can be set up to 600 W/mK and, therefore, can be set so high that harmful heating of the layer structure or, respectively, of the electrophotographic material is avoided. Thermoelectric effects are therefore suppressed.

Extremely low permeation coefficients for water, approximately $10^{-3}$ $m^2/s$, can be achieved with a—C:H, so that an extraordinarily high moisture barrier effect is established. The electrostatic properties of the amorphous carbon layer therefore also remain constant in a humid environment, charges generated on the surface cannot flow off via tracking current paths. Chemically, the amorphous carbon is entirely inert, so that it experiences no modification even given the influence of solvents or other chemical substances. Nc toxic effects have been observed either in the manufacture or in the utilization of an amorphous, hydrogen-containing carbon layer in an electrophotographic recording material. The abrasion of such a layer is extremely low since it has a Knoop hardness of more than 1200 kp/$mm^2$ and, therefore, is extremely resistant to scratching. With a coefficient of friction of about 0.023, the surface friction is extremely low. These two characteristics together yield a high resistance to wear.

Standard plasma deposition methods, for example a microwave-excited plasma or a radio frequency plasma, are suitable for the manufacture of an amorphous, hydrogen-containing carbon layer having the aforementioned properties. As a result thereof, the manufacturing method is compatible with the conditions for the manufacture of suitable photoconductive materials, for example with the production of amorphous silicon. The material a—C:H has good adhesion to these materials and to metals insofar as the latter form carbides. Arbitrary electrophotographic recording materials can therefore be combined with an uppermost layer of amorphous carbon that is excellently suited as a protective layer due to the mentioned properties. The optical band spacing of the material can be set to values above 2 eV, so that the material is adequately permeable to light.

Due to a suitable selection of the deposition conditions for the amorphous carbon layer, a semiconducting material can be produced that has a hole density of less than $10^{18}$ $cm^{-3}$ $eV^{-1}$ in the band gap, that has a photoluminescence and a photoconductivity of greater than $10^{-6}$ $\Omega m^{-1/W}$ and a band gap of 0.8–3 eV.

As a result of the amorphous structure, the a—C:H material can be very uniformly applied, so that grain boundary effects and the like cannot appear in the image transfer.

The electrical dielectric strength amounts to more than 150 V/μm. The hole density can be set between $10^{16}$ and $10^{17}$ $m^{-3}$ $eV^{-1}$ and can be adapted to the requirements that exist in xerography with respect to the cross diffusion of surface charges. The thermoconductivity amounts to a maximum of about 600 W/mK and can even exceed that of copper. Due to the good thermally-conductive properties of the a—C:H material, harmful heating of the material and thermoelectric effects do not occur.

It is therefore possible, according to the present invention, to already meet the initially-mentioned requirements for an electrophotographic recording material with a monolayer structure of a—C:H material.

Further advantages with respect to adhesion and photoconduction of the a—C:H layer, however, are achieved when this layer is applied over an arbitrary, further carbide-forming semiconductor layer, for example over amorphous silicon (a—Si:H).

The photoconductive properties (charge carrier transport and charge carrier generation) that were heretofore unknown for amorphous carbon, however, require a modified plasma deposition process. A carbon is thereby produced whose properties are even more similar to those of the diamond than are known amorphous carbon layers. Such a process and further details for practicing the present invention shall be set forth in yet greater detail below in an exemplary embodiment and with reference to the drawing.

BRIEF DESCRIPTION OF THE DRAWING

Other objects, features and advantages of the invention, its organization, construction and operation will be best understood from the following detailed description, taken in conjunction with the accompanying drawing, on which there is a single FIGURE which is a schematic illustration of a plasma deposition reactor for producing the a—C:H layer with radio frequency excitation.

DESCRIPTION OF THE PREFERRED EMBODIMENTS

Referring to the drawing, a gaseous hydrocarbon, for example methane $CH_4$, is introduced into a cylindrical silica glass vessel 1 as a reaction gas (see the arrow 2) at a pressure of 200 Pa. The reaction gas 2 proceeds into a plasma 5 formed between two unequal electrodes 3 and 4 which have an area ratio 1:5–1:8, for example 1:6 and with a volume of approximately 400 $cm^3$. The two electrodes 3 and 4 have a spacing of 1–5 cm. preferably 2.5 cm and are connected to a radio frequency generator 6 (fg=13.56 MHz). Due to the unequal size of the electrodes 3 and 4, a self-bias DC voltage arises between the electrodes 3 and 4 and superimposes on the radio frequency voltage of the generator 6. The smaller electrode 3 carries the substrates 7 to be coated and can be composed of a xerography plate or a xerography drum and becomes the cathode. The anode 4 is preferably grounded as indicated at 13.

Given a radio-frequency power density of approximately 1.3 W $cm^{-2}$ (±50%) with reference to the cathode area 3, a self-bias DC voltage of up to 150 V arises between the two electrodes 3 and 4. Approximately 1/10 thereof is transferred onto the depositing ions as kinetic energy. The generated self-bias voltage is generally dependent on the applied radio frequency voltage, on the area ratio of the electrodes, and on the gas pressure. A lower gas pressure generates a higher self-bias voltage, as does a higher ratio frequency voltage. Due to the sputter effects occurring with a higher ion energy, however, the conditions are selected such that a self-bias DC voltage of no more than 1 KV is established. With a self-bias DC voltage of approximately 100 V, an approximately 1 μm thick a—C:H layer having an intrinsic photoconductivity of more than $1\times10^{-6}\ \Omega m^{-1}/W$ given a dark conductivity of below $10^{-1}\ \Omega m^{-1}$ and a dielectric strength of more than 150 V/μm is obtained after 10 minutes on a Si-containing surface (Si wafer) 7 at a deposition rate of approximately 1.7 $nm\times s^{-1}$ in a $CH_4$ mass flow through of $8.8\times10^{-4}\ Pa\times Cm\times s^{-1}$. These values are achieved by a a—C:H material having an H/C ratio of 0.3 given up to 68% $sp^3$hybridized carbon.

As a further modification, the method can be implemented with a carrier gas, for example with argon, that can then also serve as an energy store (surge energy) for the plasma or, respectively, for the ions. It is also possible to employ a mixture of hydrocarbons and hydrogen as the process gas. The deposition rate can also be controlled therewith. Given a high deposition rate and/or high ion energy, the cooling of the substrate or substrates 7 or, respectively, of the electrode 3 carrying the substrates can be necessary.

In the recording material processing system illustrated on the drawing, standard, commercially-available elements are employed including a flow regulator 8 for regulating the methane flow, a pressure measurer and indicator 9, pressure regulating devices 10 and 11 and a vacuum pump 12 for evacuating the reaction vessel 1.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. An electrophotographic recording element comprising:

a substrate; and a plurality of layers arranged in a layer structure carried on said substrate, said layer structure comprising a photoconductive layer, and the uppermost layer, with respect to said substrate, comprising an amorphous hydrogen-containing carbon material, said uppermost layer also constituting said photoconductive layer.

2. The electrophotographic element of claim 1, wherein:

said uppermost layer is an amorphous hydrogen-containing carbon layer and is also said photoconductive layer.

3. The electrophotographic recording element of claim 1, and further comprising:

a layer of carbide-forming semiconductor material supporting said photoconductive amorphous hydrogen-containing carbon layer.

4. The electrophotographic recording element of claim 3, wherein:

said carbide-forming semiconductor material is amorphous silicon.

5. The electrophotographic recording element of claim 1, wherein said photoconductive amorphous hydrogen-containing carbon layer comprises:

optical band spacing of 0.8–2.8 eV;

an H/C ratio of 0.15–0.6; and an $sp^3$ hybridization degree of the c atoms of at least 68%.

6. The electrophotographic recording element of claim 5, wherein:

the H/C ratio is 0.3.

7. The electrophotographic recording element of claim 1, wherein:

said uppermost layer of amorphous hydrogen-containing carbon material covers said photoconductive layer; and said photoconductive layer comprises a material different from that of said uppermost layer.

8. The electrophotographic recording element of claim 1, wherein:

said substrate is a plate.

9. The electrophotographic recording element of claim 1, wherein:

said substrate is a drum.

10. A method of producing an amorphous hydrogen-containing layer for an electrophotographic recording element, comprising the steps of:

supporting a substrate on a cathode electrode spaced from an anode electrode within a vessel and in a hydrocarbon-containing low-pressure atmosphere; and applying a radio frequency signal across the cathode and anode electrode to excite a plasma generation therebetween and superpose a DC bias voltage thereacross causing deposition of an amorphous hydrogen-containing carbon layer on the substrate.

11. The method of claim 10, and further comprising the step of:

setting the DC voltage as a self-bias voltage by selecting the area sizes of the electrodes.

12. The method of claim 11, wherein the step of setting is further defined as:

selecting the area sizes of the electrodes such that the cathode to anode area ratio is less than or equal to 1:5.

13. The method of claim 10, wherein the steps of supporting and applying are further defined as:

setting the spacing of the electrodes to be in the range of 1–5 cm;

establishing a pressure of the atmosphere in the vessel of 100–500 Pa; and establishing a ratio frequency power density of 0.5–2 W $cm^{-2}$, whereby the pressure and area ratio are matched to one another such that a self-bias DC voltage of a maximum of 1000 V arises.

14. The method of claim 10, and further comprising the step of:

supplying the atmosphere to the vessel as a gas selected from the group consisting of methane, ethane and a mixture of methane and ethane as a hydrocarbon-containing reaction gas.

15. The method of claim 10, and further comprising the step of:

cooling the substrate.

16. The method of claim 10, and further comprising the step of:

cooling the cathode electrode.

* * * * *